US005772801A

United States Patent [19]

Baldi et al.

[11] Patent Number: 5,772,801

[45] Date of Patent: Jun. 30, 1998

[54] PROCESS FOR THE FORMING OF METAL ALLOY WHEEL RIMS

[75] Inventors: Valter Baldi, Bologna, Italy; David J. Edwards, deceased, late of Marquette, Mich., by David E. Edwards, legal representative

[73] Assignee: Reynolds Wheels S.p.A., Bologna, Italy

[21] Appl. No.: 717,717

[22] Filed: Sep. 23, 1996

[30] Foreign Application Priority Data

Sep. 29, 1995 [IT] Italy ..... B095A0460

[51] Int. Cl.[6] ..... C22F 1/00; B60B 21/00

[52] U.S. Cl. ..... 148/552; 148/583; 148/552; 148/549; 148/538; 148/437; 301/65

[58] Field of Search ..... 148/583, 552, 148/549, 538, 437; 301/62, 65

[56] References Cited

U.S. PATENT DOCUMENTS 4,579,604 4/1986 Beyer ..... 148/12.7

4,624,038 11/1986 Walther ..... 29/159.01

5,409,555 4/1995 Fujita et al. ..... 148/583

FOREIGN PATENT DOCUMENTS 366049 5/1990 European Pat. Off. .

*Primary Examiner*—David A. Simmons
*Assistant Examiner*—M. Alexandra Elve
*Attorney, Agent, or Firm*—Fay, Sharpe, Beall, Fagan, Minnich & McKee

[57] ABSTRACT

In a process for the forming of wheel rims in metal alloy, a cast blank undergoes a cold chip removal process by cutting its central area, its inner surface and its lateral surface in order to obtain a semi-finished work which is then heated and plastically deformed by flow forming along its lateral surface to obtain an inner edge, an outer edge and a middle portion with a defined machine allowance; the rim thus obtained undergoes another cold chip removal process by cutting in order to work it down to the required size; the latter process may be preceded by solution and age hardening heat treatments.

12 Claims, 2 Drawing Sheets

PROCESS FOR THE FORMING OF METAL ALLOY WHEEL RIMS

BACKGROUND OF THE INVENTION

The present invention relates to a process for forming wheel rims in metal alloy.

Conventional single-piece forming processes used in the manufacture of wheel rims can be divided broadly into two types.

In processes of the first type, a semi-finished part or rim blank is obtained by a forging process, which consists in hot forming the metal alloy while it is ductile enough to make a rim of the required shape with the minimum of work. Rims made using this process have good mechanical properties but cannot have complex shapes. In forging, the blank is heated and then deformed by repeated application of a compressive force alternated, if necessary, with further heating operations. That means that complicated shapes, such as wheel rims, can be obtained only approximately. Moreover, the process involves several finishing operations which are not only complex but also very time-consuming. A process of this kind applied to the manufacture of wheel rims is described, for example, in U.S. Pat. No. 4,528,734.

In known processes of the second type, the semi-finished part or rim blank is obtained by casting in any of the known modes, for example, low pressure or gravity casting in dies made of refractory sand or metal. Shaping a metal by casting it in its molten state is a short and economical way to obtain products in a wide variety of shapes, even the most intricate. The mechanical quality of such products is, however, lower than that of forgings, mainly on account of defects such as microshrinkage or microporosity in the structure of the metal and, consequently, further processing and heat treatments are required to improve their mechanical properties. A process of this kind applied to the manufacture of wheel rims is described, for example, in U.S. Pat. No. 5,092,040.

The aim of the present invention as characterized in the claims below is to make improvements to casting technology by overcoming the typical drawbacks without affecting the advantages of the casting process constituted by its simplicity and low cost.

SUMMARY OF THE INVENTION

This aim is achieved in the present invention by providing a process for the forming of metal alloy wheel rims starting from cast blanks.

BRIEF DESCRIPTION OF THE DRAWINGS

Further characteristics and advantages of the invention are apparent from the detailed description which follows, with reference to the accompanying drawings, in which.

DESCRIPTION OF THE PREFERRED EMBODIMENTS

Figure 4:
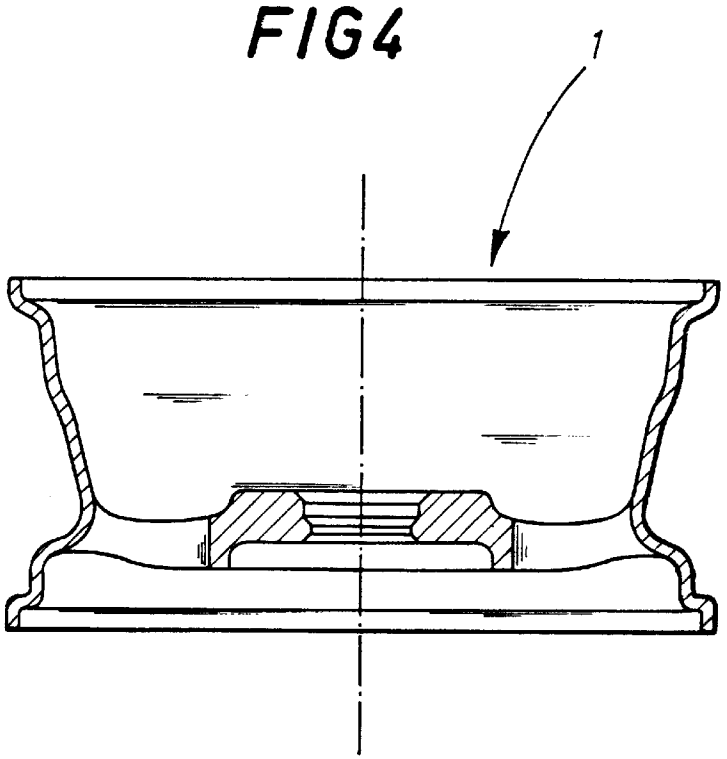
FIG. 4 illustrates a wheel rim obtained using the process illustrated in FIGS. 1, 2 and 3.
Figure 1:
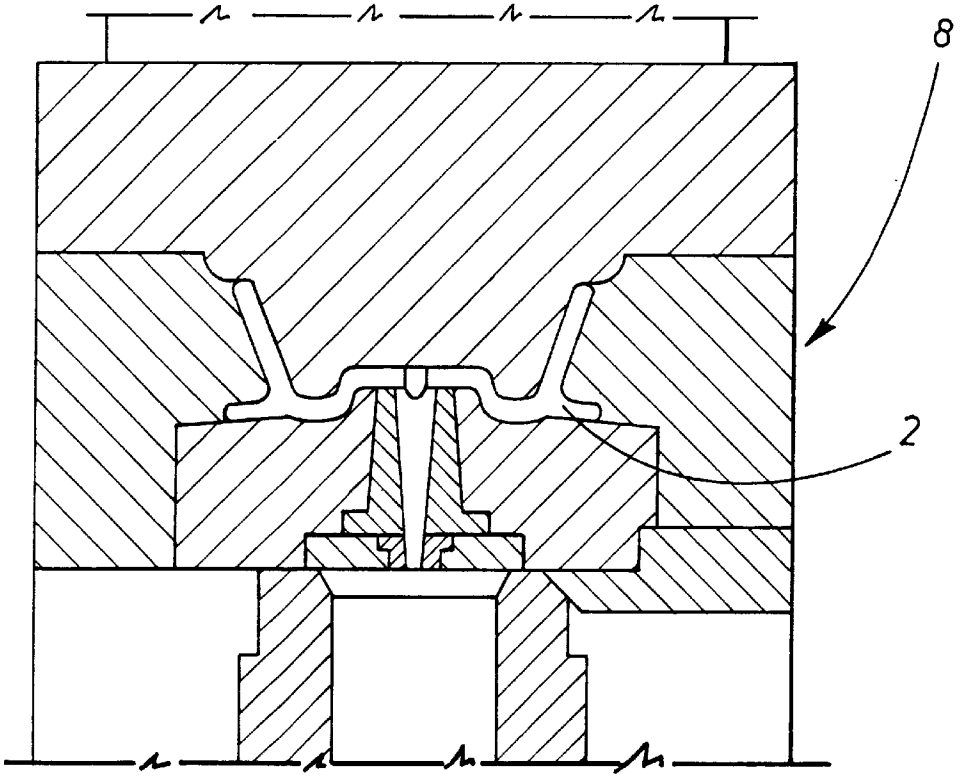
FIG. 1 shows a blank and the die used to obtain it, schematically and in cross section.

With reference to the drawings listed above, the process for the forming of metal alloy wheel rims 1 envisages that an unworked piece or blank 2 be obtained by a casting process in which aluminum alloy billets are melted and the molten metal is then poured into the cavity of the die 8 of the blank 2. The blank 2 thus obtained is approximately in the shape of a double Y, in diametral cross section, with nearly constant thickness in all the branches of the Y section. This type of section avoids problems that may arise when thicknesses differ on account of nonuniform cooling of the blank.

When the time necessary to solidify the alloy has elapsed, the blank 2 is extracted from the die 8 and cold machined. The cold machining process (refer to FIG. 2) envisages a first chip removal operation in which the blank is rotated about its axis 20 and material cut away from its central portion 9, to make the hole for the hub, from the inner surface 4 of the blank 2 and from the lateral surface 12 of the blank 2. For clarity, the said first machining process is shown with a dashed line in FIG. 2. This machining process removes material from the blank 2 to generate a reference surface for subsequent machine operations and, at the same time, creates a blank of defined dimensions which hereinafter will be referred to as semi-finished work 3.

The reason for this first machine operation is that the casting process cannot guarantee a constant volume of material in all sections of the blank. The material must, however, be distributed uniformly all round the blank, that is to say, the allowance on the entire circumferential surface of the blank must be the same.

In this regard, it must be stressed that it is very important to guarantee that there are constant volumes of material distributed uniformly along the entire circumference of the blank 2. In fact, this is essential to enable the subsequent compression process known technically as "flow forming", to be carried out on the blank 2, this being a process which requires uniform thicknesses along the entire surface of the blank 2. If the thicknesses are different, the flow forming process applies nonuniform forces to the blank while it is being rotated. This gives rise to vibrations and knocking, preventing the process from proceeding correctly and worsening the quality of the result.

In such an event, the subsequent removal of excess burrs would require further processing, on a lathe, for example. Moreover, since the excess burrs would not be distributed uniformly, even lathing would be hampered by the resulting shocks and vibrations. In all events, therefore, it is very important that the total volume of material of the semi-finished work 3, including the uniformly distributed machining allowance, is within well-defined limits so as to avoid burring due to excess material, which would have to be removed by further machining.

In short, the subsequent flow-forming process is a constant volume process where the work has to have a well-defined, constant volume of material to start with.

The lathe turning process on the lateral surface 12 also creates a groove 6 (see FIG. 2) whose shape matches the outer profile of a flow forming roller 5. The purpose of this groove is explained in more detail below.

Figure 3:
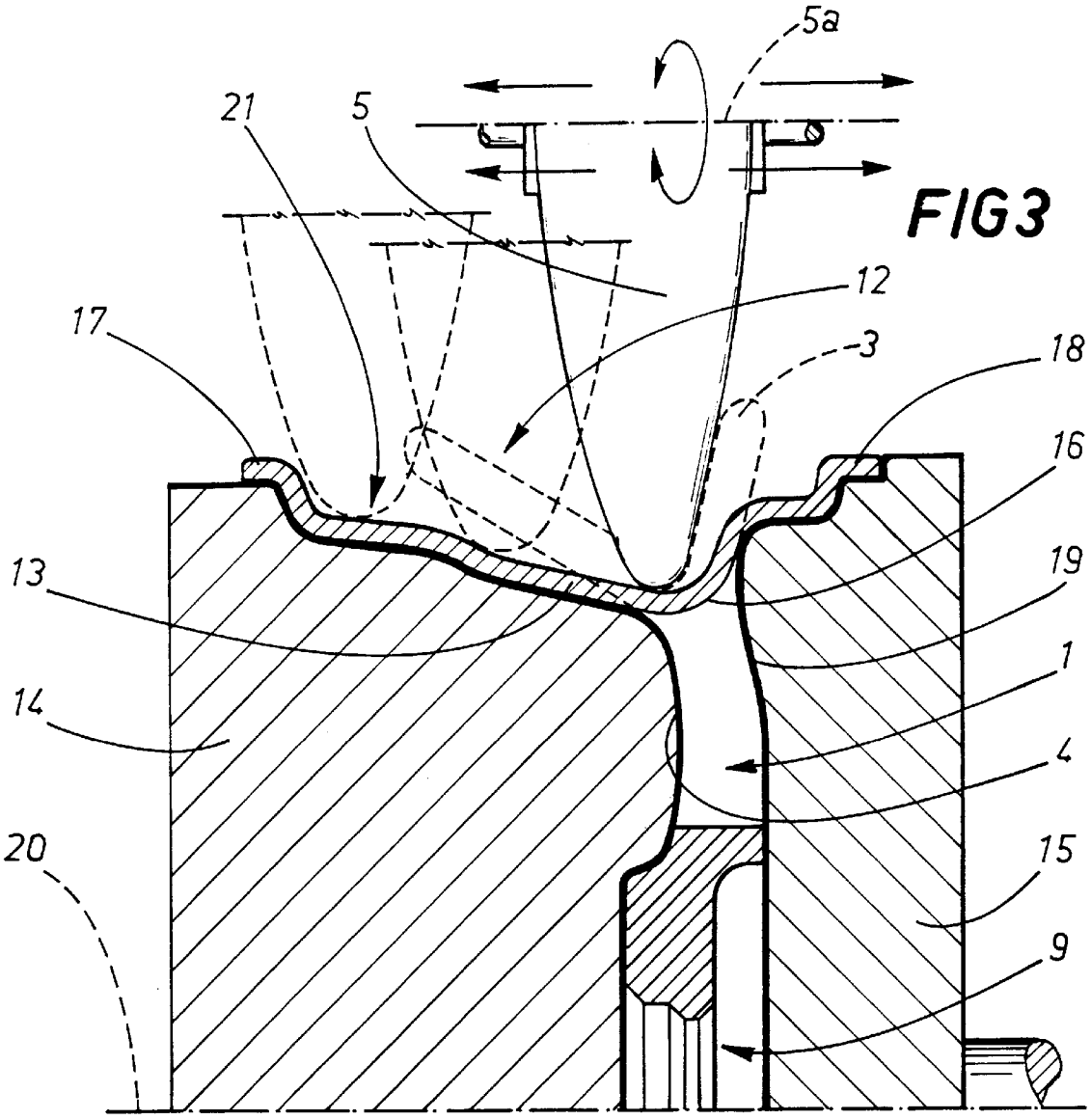
FIGS. 2 and 3 show, schematically and in cross section half views, the sequence of steps in a single-piece forming cycle of a wheel rim according to the present invention.
Figure 2:
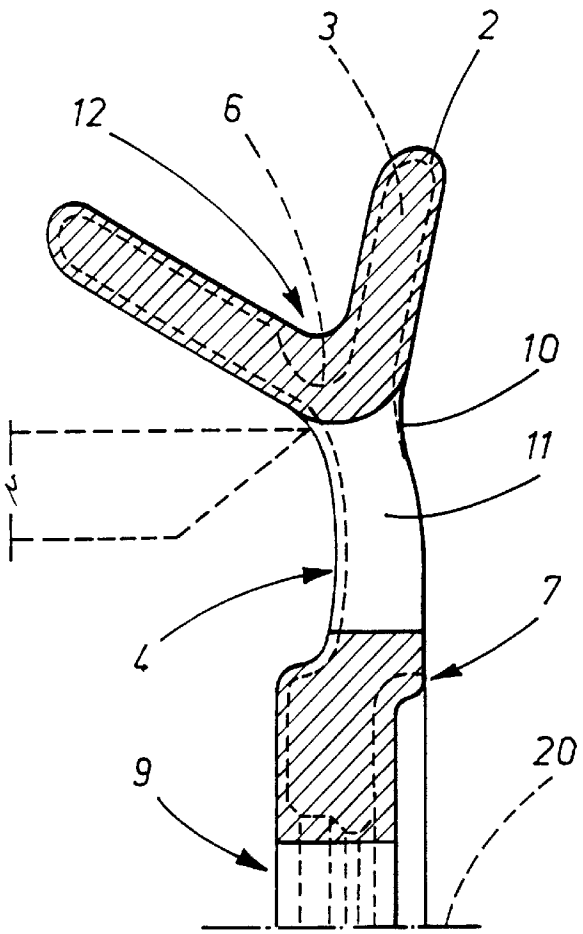

Next, the semi-finished work 3, that is, the one shown with the dashed line in FIGS. 2 and 3, is heated in a furnace to a temperature of preferably 380° to 400° C. During the subsequent flow forming process, the semi-finished work 3 heated in this way can be plastically deformed more easily and using less energy. Heating also avoids the problem of cracking which often arises in cold machining processes. Moreover, combined with the subsequent flow forming, it contributes to the elimination of casting defects.

After being heated, the semi-finished work 3 is fixed to a spindle 14 of a special flow forming lathe and locked in place by a tailstock 15 which rests against the front 19 of the rim 1, the outer shape of the spindle 14 substantially corresponding to the required end shape of the inner surface 4 of the rim 1. The semi-finished work 3 and the spindle 14 are turned about an axis which corresponds to the axis of rotation 20 of the rim. In this way, the subsequent flow forming process on the lateral surface 12 of the rim guarantees the concentricity of the lateral surface 12 with the axis of rotation 20.

The semi-finished work 3 is machined by flow forming on the areas constituted by the lateral surface 12 to create a channel 21 with an inner edge 17, an outer edge 18 and a middle portion 13, leaving a defined machining allowance depending on the subsequent heat treatments.

The flow forming process consists of a series of axial-symmetric forming operations whereby a rotating workpiece is compressed into shape by a suitable rolling tool 5 which rolls the material down to a predefined thickness.

The roller 5, only a half of which is illustrated in FIG. 3, should preferably be made of hardened steel and be rotated about its axis 5*a* by a known type of drive motor so that its peripheral speed is the same as that of the surface of the semi-finished work 3 so as to prevent the development of considerable tangential forces due to tangential friction between the two surfaces.

Initially, the roller 5 is inserted into the groove 6, made previously by the cold machining process, without compressing the lateral surface of the rim 1. It is necessary to proceed in this way because the rim, in the area of the disc 7, usually consists of an alternate sequence of spokes 10, that is, parts full of material, and gaps 11, that is, spaces free of material. If the roller 5 is inserted into the lateral surface 12 in an area corresponding to a gap 11, the thickness of the wall 16 is relatively small and contrasts the compressive action of the roller. Therefore, if the groove 6 is not made by cutting away material but by compression instead, the wall 16 of the lateral surface 12 would buckle. Nor would it possible to support the wall 16 of the lateral surface 12 in the area corresponding to the gap 11 since the tailstock 15 rests only against the front 19 of the rim and it would be extremely complicated to construct a tailstock to fit exactly into the gaps 11 of the rim 1 so as to provide adequate support for the wall 16 of the lateral surface 12. The groove 6 is also necessary to start the flow forming process on the lateral surface since the material must be rolled down to the required, smaller thickness in a single pass of the roller 5. According to a general embodiment, when the roller 5 is inserted into the groove 6 it moves sideways first in the direction of the front 19 of the rim 1, thus forming the outer edge 18, and then, after being inserted into the groove 6 again, moves sideways in the direction opposite the front 19, so as to form the inner edge 17 and the middle portion 13.

According to another embodiment, the outer edge 18 of the rim 1 is made beforehand at the casting stage because its axial dimensions are considerably smaller than those of the inner edge 17 and the middle portion 13. In this case, the flow forming process on the outer edge 18 is omitted and this part is only cold processed by removal of material It should be noted that the profile of the lateral surface 12 of the roller 5 is formed by the combination of the two movements of the roller 5 in the axial and tangential directions with respect to the rim 1; the roller is driven preferably by a computer numerical control (CNC) system.

The compression generated by the flow process on the heated material squeezes out typical casting defects such as microporosity and microshrinkage and, in so doing, greatly improves the mechanical properties of the material. In particular, the wall 16 of the lateral surface 12 of the rim may be made considerably thinner than the corresponding wall of a rim obtained by casting. Moreover, the flow forming process totally eliminates the problem of air leaks through microporosity in the rim material, this being a significant improvement if one considers that practically all tires currently made are tubeless.

The process described above should preferably be followed by a solution heat treatment designed to hold, that is, retain the solid solution of the previously heated alloy. This treatment homogenizes the structure of the material deformed by the earlier flow forming process and relieves internal stress, especially in the area where the lateral surface 12 joins the disc 7. The solution heat treatment may be followed by age hardening in order to further improve the mechanical properties of the alloy.

These heat treatments, however, cause dimensional and geometrical variations in the rim. It is therefore necessary to leave a certain amount of machine allowance so that the rim can be worked down to the required size and shape by a suitable chip removal process.

The rim is then cold processed by cutting material away from the entire lateral surface 12, including the inner edge 17, the outer edge 18 and the middle portion 13, to remove the machining allowance left by the earlier flow forming process and to work the rim down to the required size. This process should preferably be performed using a diamond cutting tool capable of dealing with the considerable hardness of the alloy following the age hardening treatment and of producing a fine surface finish. The latter mechanical process also guarantees the perfect static and dynamic balance of the rim.

Finally, the holes for fixing the rim to the hub and the hole for the valve are made in the rim using known methods.

Although the manufacturing process described above is relatively simple, the rims 1 obtained in this way, illustrated in FIG. 4, have similar mechanical properties to forged rims and are better quality than cast rims.

The invention described can be subject to modifications and variations without thereby departing from the scope of the inventive concept. Moreover, all the details of the invention may be substituted by technically equivalent elements.

What is claimed:

1. A process for the forming of wheel rims in metal alloy of the kind comprising a disc from which an alternating sequence of spokes and gaps is made and of a lateral surface defined by a middle portion delimited by an inner edge and an outer edge, the process characterized in that it comprises the following steps:

obtaining a blank by a casting process, the blank being approximately in the shape of a double Y, in a diametrical cross section;

mechanically cold processing the blank by cutting material away from its central area, from the inner surface of the disc and from its lateral surface;

heating the semi-finished work in a furnace;

fixing the heated semi-finished work across a spindle and a tailstock;

turning the spindle and the semi-finished work about an axis corresponding to the axis of rotation of the rim;

after mechanically cold processing the blank, flow forming by passing a roller over the areas constituted by the lateral surface of the semi-finished work to create a channel with an inner edge, an outer edge and a middle portion, leaving a defined machining allowance depending on the subsequent heat treatments; and mechanically cold processing the rim by cutting material away from the lateral surface, including the inner edge, the outer edge and the middle portion, to remove the machining allowance left by the earlier flow forming process and to work the rim down to the required size.

2. A process for forming wheel rims in a metal alloy comprising a disc from which an alternating sequence of spokes and gaps is made and of a lateral surface defined by a middle portion delimited by an inner edge and an outer edge, the process comprising:

a) casting a blank;

b) mechanically cold processing the blank by cutting material away from its central area, from the inner surface of the disc and from its lateral surface to create a semi-finished work having a substantially constant volume of material distributed uniformly around the blank;

c) heating the semi-finished work;

d) fixing the heated semi-finished work across a spindle and locking the semi-finished work using a tailstock;

e) turning the spindle and the semi-finished work about an axis corresponding to the axis of rotation of the rim;

f) after the step b of mechanical cold processing, flow forming by passing a roller over the areas constituted by the lateral surface of the semi-finished work to create a channel with an inner edge, an outer edge and a middle portion, leaving a defined machining allowance depending on the subsequent heat treatments; and g) mechanically cold processing the rim by cutting material away from the lateral surface, including the inner edge, the outer edge and the middle portion, to remove the machining allowance left by the earlier flow forming process and to work the rim down to the required size.

3. The process according to claim 2, characterized in that the solution heat treatment is followed by an age hardening treatment.

4. The process according to claim 2, characterized in that the step b) of cold mechanical processing creates a groove that substantially matches the shape of an outer profile of the flow forming roller.

5. The process according to claim 4, characterized in that the step f) of flow forming begins by inserting the roller into the groove.

6. The process according to claim 2, characterized in that the step f) of flow forming rolls the areas down to a predefined thickness.

7. A process for forming wheel rims in a metal alloy comprising a disc from which an alternating sequence of spokes and gaps is made and of a lateral surface defined by a middle portion delimited by an inner edge and an outer edge, the process comprising:

casting a blank rim having an outer edge;

mechanically cold processing the blank by cutting material away from its central area, from the inner surface of the disc and from its lateral surface to create a semi-finished work having a substantially constant volume of material distributed uniformly around the blank;

heating the semi-finished work;

fixing the heated semi-finished work across a spindle and locking the semi-finished work using a tailstock;

turning the spindle and the semi-finished work about an axis corresponding to the axis of rotation of the rim;

after mechanically cold processing the blank, flow forming by passing a roller over the areas constituted by the lateral surface of the semi-finished work to create a channel with an inner edge and a middle portion, leaving a defined machining allowance depending on the subsequent heat treatments; and mechanically cold processing the rim by cutting material away from the lateral surface, including the inner edge, the outer edge and the middle portion, to remove the machining allowance left by the earlier flow forming process and to work the rim down to the required size.

8. The process according to claim 7, characterized in that the step of flow forming includes a series of axial-symmetric forming operations.

9. The process according to claim 7, characterized in that axial dimensions of the outer edge are smaller than axial dimensions of the inner edge and the middle portion.

10. The process according to claim 7, characterized in that the step of mechanically cold processing the blank creates a groove that substantially matches the shape of an outer profile of the flow forming roller.

11. The process according to claim 10, characterized in that the step of flow forming begins by inserting the roller into the groove.

12. The process according to claim 7, characterized in that the roller is driven by a computer numerical control system.

* * * * *